US011486191B2

(12) United States Patent
Schlögl

(10) Patent No.: US 11,486,191 B2
(45) Date of Patent: Nov. 1, 2022

(54) BUILDING FACADE ELEMENT EMBODIED AS AN INSULATING GLASS UNIT

(71) Applicant: sedak GmbH & Co. KG, Gersthofen (DE)

(72) Inventor: Fritz Schlögl, Stadtbergen (DE)

(73) Assignee: sedak GmbH & Co. KG, Gersthofen (DE)

( * ) Notice: Subject to any disclaimer, the term of this patent is extended or adjusted under 35 U.S.C. 154(b) by 101 days.

(21) Appl. No.: 16/979,013

(22) PCT Filed: Mar. 8, 2019

(86) PCT No.: PCT/EP2019/055866
§ 371 (c)(1),
(2) Date: Sep. 8, 2020

(87) PCT Pub. No.: WO2019/170869
PCT Pub. Date: Sep. 12, 2019

(65) Prior Publication Data

US 2020/0408032 A1 Dec. 31, 2020

(30) Foreign Application Priority Data

Mar. 9, 2018 (DE) ..... 10 2018 105 479.3

(51) Int. Cl.
*E06B 3/663* (2006.01)

(52) U.S. Cl.
CPC ..... *E06B 3/66333* (2013.01); *E06B 2003/66338* (2013.01)

(58) Field of Classification Search
CPC ..... E06B 3/66; E06B 3/6612; E06B 3/663; E06B 3/66304; E06B 3/66309;
(Continued)

(56) References Cited

U.S. PATENT DOCUMENTS 4,215,164 A * 7/1980 Bowser ..... C09J 123/22 428/441
5,007,217 A * 4/1991 Glover ..... E06B 3/66328 52/204.593

(Continued)

FOREIGN PATENT DOCUMENTS

CN 104649591 A 5/2015
DE 3110874 A1 9/1982

(Continued)

OTHER PUBLICATIONS

International Search Report and Written Opinion for PCT/EP2019/055866, filed Mar. 8, 2019.

(Continued)

*Primary Examiner* — Kyle J. Walraed-Sullivan
(74) *Attorney, Agent, or Firm* — Paul D. Bianco; Stephen Bongini; Fleit Intellectual Property Law

(57) ABSTRACT

A building façade element embodied as an insulating glass unit includes at least one first and one second glass pane, at least one glass spacer consisting of glass, which is connected to each glass pane by at least one sealant, at least one other spacer which is gas-tight or comprises a gas-tight layer and is connected to each glass pane by at least one second sealant, and at least one joining region for a glass spacer and another spacer. The at least one glass spacer, the at least one other spacer and the glass panes form a closed inner chamber that does not affect the visual appearance. To this end, the at least one joining region is closed by a third sealant in a gas-tight manner, with the sealant containing butyl and being guided over the joining region.

20 Claims, 5 Drawing Sheets

(58) Field of Classification Search
CPC ..... E06B 3/66314; E06B 3/66319; E06B 3/66328; E06B 3/66333; E06B 3/66342; E06B 3/66352; E06B 3/667; E06B 3/67321; E06B 3/67326; E06B 2003/66338
See application file for complete search history.

(56) References Cited

U.S. PATENT DOCUMENTS

| | | | | |
|---|---|---|---|---|
| 5,260,112 | A | 11/1993 | Grether | |
| 5,657,607 | A * | 8/1997 | Collins | E06B 3/66304 52/786.13 |
| 6,329,030 | B1 * | 12/2001 | Lafond | E06B 3/66328 52/786.13 |
| 10,190,359 | B2 | 1/2019 | Messere | |
| 2009/0233020 | A1 * | 9/2009 | O'Shaughnessy | E06B 3/66328 156/103 |
| 2012/0090253 | A1 * | 4/2012 | Beresford | E06B 3/66333 52/204.593 |
| 2012/0137608 | A1 * | 6/2012 | Plant | E06B 3/66314 52/204.593 |
| 2017/0089123 | A1 * | 3/2017 | Canning, Jr. | E06B 3/66342 |
| 2018/0216396 | A1 * | 8/2018 | Isaacs | E06B 3/663 |
| 2019/0090660 | A1 * | 3/2019 | Baquet | E06B 3/66352 |
| 2019/0100958 | A1 | 4/2019 | Baquet | |

FOREIGN PATENT DOCUMENTS

| | | | |
|---|---|---|---|
| DE | 9411674 | U1 | 10/1994 |
| DE | 20 2017 104538 | U1 | 10/2017 |
| EP | 0470373 | A1 | 2/1992 |
| EP | 0916801 | A2 | 5/1999 |
| EP | 2456942 | A1 | 5/2012 |
| EP | 3147443 | | 3/2017 |
| WO | 2015/086457 | A2 | 6/2015 |
| WO | 2016/091954 | A1 | 6/2016 |
| WO | 2017/157634 | A1 | 9/2017 |
| WO | 2017/157636 | A1 | 9/2017 |

OTHER PUBLICATIONS

Result of Examination Report for DE 10 2018 105 479.3, filed Mar. 9, 2018.
Written Opinion for PCT/EP2019/055866, filed Mar. 8, 2019 (English translation).
International Preliminary Report on Patentability, dated Sep. 15, 2020, with Written Opinion for PCT/EP2019/055866 (English translation), 8 pages.
Chinese Office Action dated Oct. 11, 2021 for Application No. 201980008388.0 (with translation).
Office Action dated May 30, 2022, for Chinese Patent Application No. 201980008388.0, with English translation (13 pages).

* cited by examiner

BUILDING FACADE ELEMENT EMBODIED AS AN INSULATING GLASS UNIT

FIELD OF THE INVENTION

The present invention relates to a building facade element embodied as an insulating glass unit.

BACKGROUND

In the construction of building facades, the emphasis is increasingly on the esthetic appeal of the installed elements and on the overall esthetic appeal of the building. There is a strong demand for large-area glass facades, especially with respect to complexes of large business enterprises and stores. Large-area glass facades are composed of a plurality of elements of an insulating glass unit. To satisfy the mandated requirements for building insulation and thereby keep the cost of heating and the use of air conditioning within limits, the insulating glass units are composed of a plurality of glass panes. To improve thermal insulation, an inner chamber between the glass panes is filled with a gas having low thermal conductivity. To create the inner chamber, the glass panes are connected to each other by means of spacers, especially by means of a combination of different spacers, and sealants so as to create a gas-tight seal. The seal between the spacers and the glass panes, and especially the seal of the joining region between two spacers, is of crucial importance in the creation of the gas-tight inner chamber. On large-area glass facades which can be composed of a plurality of elements of the insulating glass units, the spacers may have an undesirable effect on the visual appearance in the transition region between the elements. Such an undesirable effect can be avoided or at least reduced by using transparent spacers, especially glass spacers.

The insulating glass units known from the prior art either do not satisfy the requirements for the gas tightness of the inner chamber or they have a negative effect on the visual appearance of the insulating glass units because of the spacers used.

German Utility Model DE 94 11 674 U1 describes an element for a facade cladding made of glass in which a glass strip serves as a spacer between two parallel glass panes. This, however, creates merely an air-tight inner chamber, but not the gas-tight inner chamber required for thermal insulation.

The publication WO 2015/086457 A2 discloses an insulating glazing for a building, comprising at least two panes, a circumferential polymer or metal spacer, appropriate sealants between the panes and the spacers, and appropriate sealants in the external intermediate space between the panes and an intermediate space filled with air or gas. The connection between two spacers on the corners of the insulated glazing is implemented by a corner connector, especially a plastic molded part, in which two miter-cut spacers are adjoined to each other. The inner chamber of the glazing between the panes is filled with an inert gas before the assembly is pressed together.

The patent specification WO 2017/157634 A1 discloses an insulating glass unit which can be filled with air or gas and which has at least one transparent spacer, especially a spacer made of glass. To connect the glass pane to the spacer, a first waterproof seal, especially formed by a transparent acrylic adhesive tape, and a second gas- and water vapor-proof seal, especially made of transparent butyl, is provided. The insulating glass unit is intended for use in a climatic cabinet and is not suitable for use in a building facade, inter alia, because the seal, especially the transparent butyl used, is not sufficiently resistant to natural UV radiation.

The publication WO 2017/157636 A1 also discloses an insulating glass unit for an air-conditioned unit. The glass spacers used are cut from a glass pane and directly used in the roughly cut unprocessed condition. These glass spacers are connected to the glass pane by means of a sealant, with the sealant filling the uneven surface of the unprocessed glass spacer in the intermediate space.

German Utility Model DE 20 2017 104 538 U1 describes an insulating glass element with spacers made of glass and a plastic material or aluminum for use in multi-pane doors. The glass pane is connected to the spacer by means of an EVA (ethylene vinyl acetate) film, and the EVA film strips are disposed so as to overlap at the four corner points from the horizontal spacer and the vertical spacer. The edges are sealed in that the intermediate space between the upper and the lower glass pane up to the aluminum spacer, which is inserted at right angles thereto, is filled with a sealing compound, preferably black polysulfide.

The patent specification EP 2 456 942 B1 describes a multi-pane glazing unit with a spacer strip made of tempered glass and without a gas-tight inner chamber.

European patent applications EP 3 147 443 A1 and EP 0 470 373 A1 disclose how to seal laminated glass elements in general. The use of transparent spacers, especially spacers made of glass, is not described.

SUMMARY OF THE PRESENT INVENTION

One aspect of the present invention relates to a building facade element embodied as an insulating glass unit, wherein the insulating glass unit has a gas-tight inner chamber and the visual appearance thereof is not negatively affected.

Advantageous embodiments and further advanced modifications of the invention are also disclosed.

According to the present invention, the above-mentioned building facade element embodied as an insulating glass unit, comprising at least one first and one second glass pane, at least one glass spacer made of glass [sic], which is connected to each glass pane by means of at least one first sealant, at least one additional spacer, with the spacer being gas-tight or having a gas-tight layer and with the additional spacer being connected to each glass pane by means of at least one second sealant, at least one joining region between a glass spacer and an additional spacer, with the at least one glass spacer, the at least one additional spacer and the glass panes forming a sealed inner chamber, is characterized in that the at least one joining region is sealed to create a gas-tight seal by means of a third sealant, with the third sealant containing butyl and extending over the joining region.

In addition, the third sealant of the building facade element, which seals the joining region between a glass spacer and an additional spacer with a gas-tight seal, can comprise a metal-containing tape.

In this context, a metal-containing tape is intended to also include especially a metal-containing plastic tape and a metal tape.

According to another embodiment of the building facade element, the additional spacer has a recess in the region of the at least one joining region. The remaining non-recessed region of the additional spacer preferably extends along a short side of the glass spacer. The first sealant preferably comprises a first primary sealant on the side facing the inner chamber and a first secondary sealant on the side facing the external region. The first secondary sealant is most preferably also applied to the short side of the glass spacer. According to an advantageous embodiment, the remaining non-recessed region of the additional spacer does not extend over the entire length of the short side of the glass spacer. The third sealant preferably extends from the remaining short side of the glass spacer up to the external side of the additional spacer.

In addition, the building facade element may comprise at least one additional layer of the third sealant, which layer seals the joining region to create a gas-tight seal, or a layer of silicone, or a layer consisting of the third sealant and silicone, which layer is applied to the edge of the insulating glass unit.

The sealants used in the building facade element are preferably resistant to natural UV radiation.

According to an advantageous embodiment of the building facade element, the first sealant, by means of which the glass spacer is connected to the glass panes, or the second sealant, by means of which the additional spacer is connected to the glass panes, or both of the sealants mentioned consist(s) of a primary sealant, which is disposed on the side facing the inner chamber, and a secondary sealant which is disposed on the side facing the external region. At least one of the primary and secondary sealants mentioned is transparent. In addition, one of the primary sealants or both primary sealants may contain acrylic. According to an advantageous embodiment, one of the primary sealants or both primary sealants takes/take the form of a double-sided adhesive tape. One of the secondary sealants or both secondary sealants preferably contains/contain butyl.

According to an advantageous embodiment, the first sealant consists of a first primary sealant on the side facing the inner chamber and a first secondary sealant on the side facing the external region, with the first primary sealant containing acrylic and the first secondary sealant containing butyl, which is resistant to natural UV radiation. The first secondary sealant is preferably a black butyl sealant. Most preferably, the first primary sealant is transparent.

In addition, the inner chamber of the building facade element is filled with gas, especially with argon, krypton, xenon or a mixture of these gases.

According to yet another embodiment, at least one side of at least one of the glass panes of the building facade element has a metal coating.

According to an advantageous embodiment of the building facade element, the at least one additional spacer is a plastic spacer or a metal spacer, especially an aluminum or a stainless steel spacer.

A drying agent is preferably incorporated into the at least one additional spacer.

According to a preferred embodiment, the gas-tight layer of the at least one additional spacer is a metal-containing tape.

Preferably, the at least one additional spacer of the building facade element can be punctured in order to fill the inner chamber with gas.

According to yet another configuration, the at least one glass spacer of the building facade element consists of a plurality of components disposed adjacent to each other, or the at least one additional spacer consists of a plurality of components disposed adjacent to each other, or both combined.

BRIEF DESCRIPTION OF THE DRAWINGS

The invention will be described in greater detail below by way of exemplary embodiments with reference to the accompanying drawings. These drawings show.

DETAILED DESCRIPTION

Figure 1:
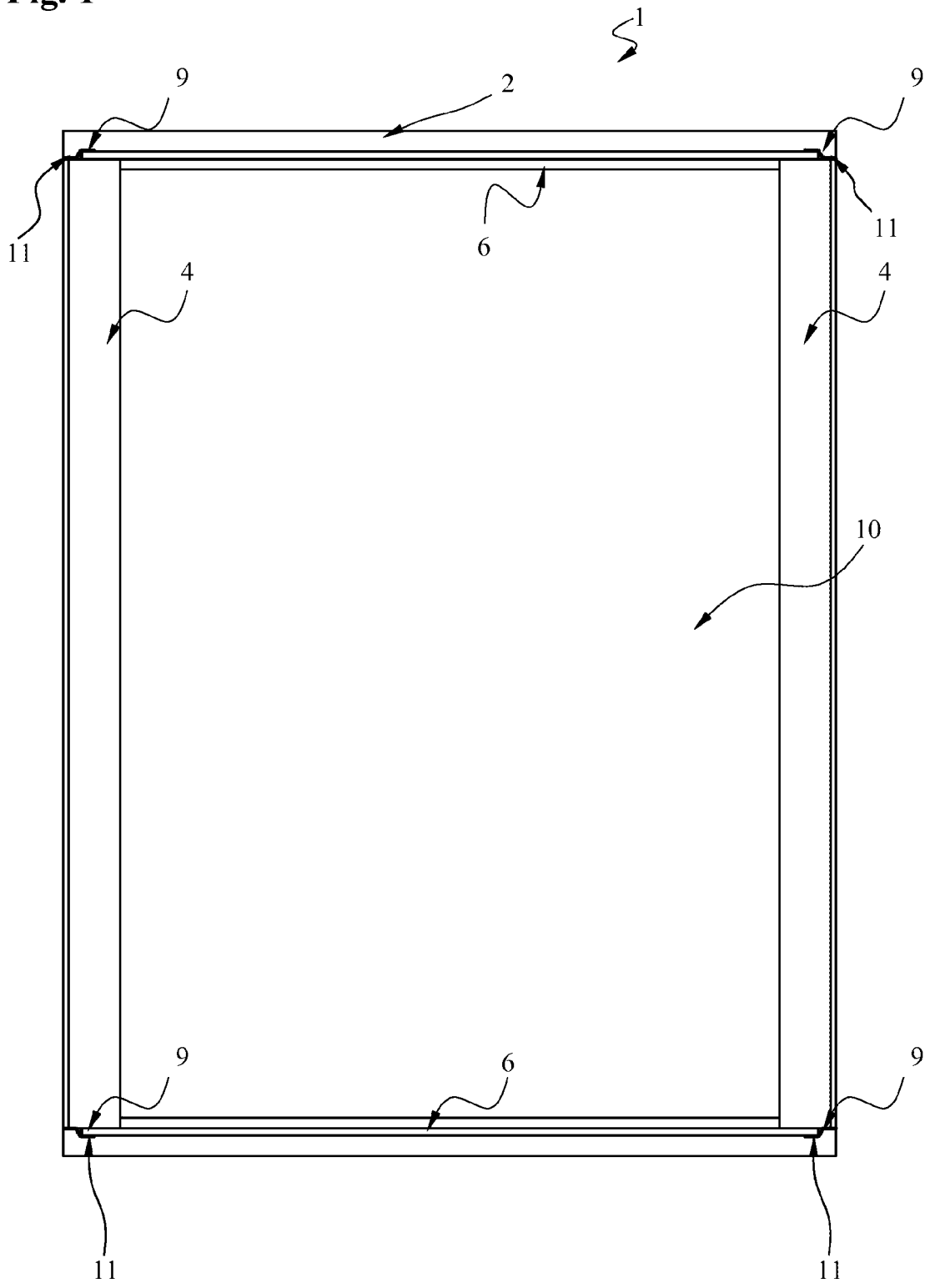
FIG. 1 a plan view of the building facade element embodied as an insulating glass unit without an upper glass pane.

FIG. 1 shows the insulating glass unit 1 without the second glass pane 3. In this figure, glass spacers 4 are disposed on the two long sides of the first glass pane 2, and the additional spacers 6 are disposed on the short sides. The glass spacers 4 are disposed to sit flush with the external edge of the first glass pane 2, while the additional spacers 6 are slightly offset in the direction of the inner chamber 10. Furthermore, the glass spacers 4 do not extend completely up to the short side of the second glass pane 3, with a portion of the short side of the glass spacers 4 being superposed by a portion of the additional spacer 6. Also shown are third sealants 11 which extend over the four joining regions 9 of the glass spacers 4 and the additional spacers 6.

Figure 2:
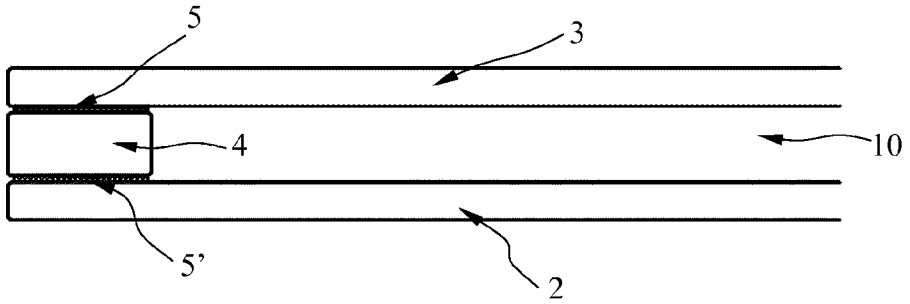
FIG. 2 a first embodiment of the connection between a glass spacer and the glass panes.

FIG. 2 shows a first embodiment of the connection between a glass spacer 4 and the glass panes 2, 3 of the insulating glass unit 1. In the region between the glass panes 2, 3 and the glass spacer 4, a first sealant 5, 5' is disposed. Also shown is the inner chamber 10 of the insulating glass unit 1. The external edge of the glass spacer 4 sits flush with the external edges of the glass panes 2, 3, while the first sealant 5, 5' does not extend completely up to the external edge. According to an alternative embodiment, the first sealant 5, 5' can also extend all the way to the external edge.

Figure 3:
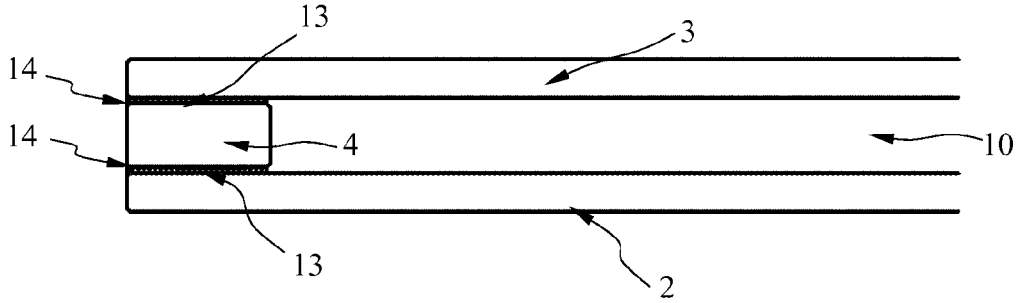
FIG. 3 a second embodiment of the connection between a glass spacer and the glass panes.

FIG. 3 shows a second embodiment of the connection between a glass spacer 4 and the glass panes 2, 3 as shown in FIG. 2. The first sealant 5, 5' consists of a first primary sealant 13 on the side facing the inner chamber 10 and a first secondary sealant 14 on the side facing the external region. The first secondary sealant 14 sits flush with the edges of the glass panes 2, 3.

Figure 4:
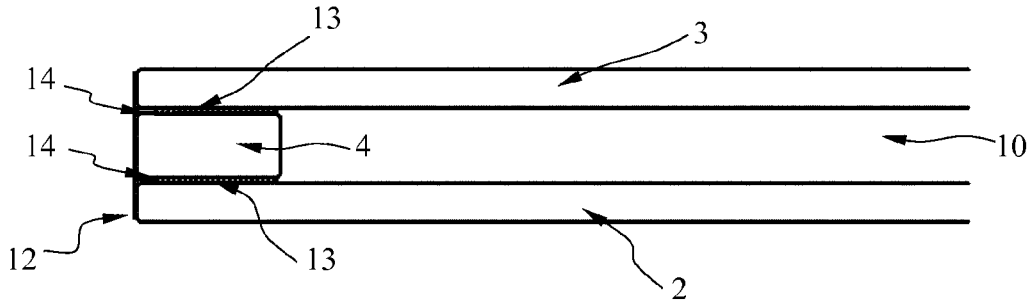
FIG. 4 a third embodiment of the connection between a glass spacer and the glass panes.

FIG. 4 shows a third embodiment of the connection between a glass spacer 4 and the glass panes 2, 3 as shown in FIG. 3. Applied to the external edge is an additional layer 12 which extends over the glass panes 2, 3 and the glass spacer 4.

Figure 5:
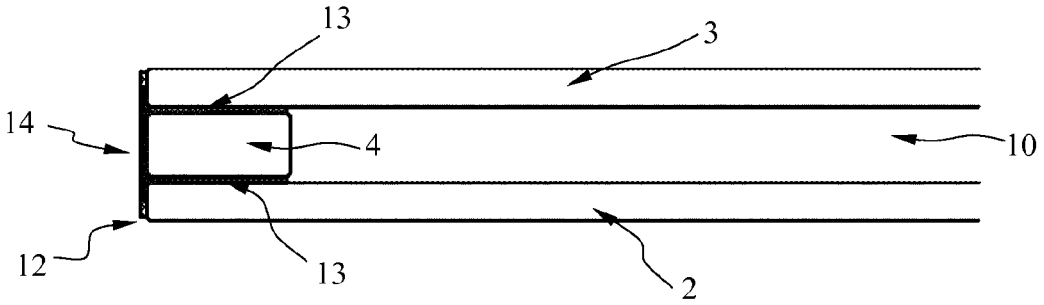
FIG. 5 a fourth embodiment of the connection between a glass spacer and the glass panes.

FIG. 5 shows a fourth embodiment of the connection between a glass spacer 4 and the glass panes 2, 3 as shown in FIG. 4, wherein the first secondary sealant 14 is not disposed in the intermediate space between the glass spacer 4 and the glass panes 2, 3, but on the external edge instead. The additional layer 12 extends over the first secondary sealant 14.

Figure 6:
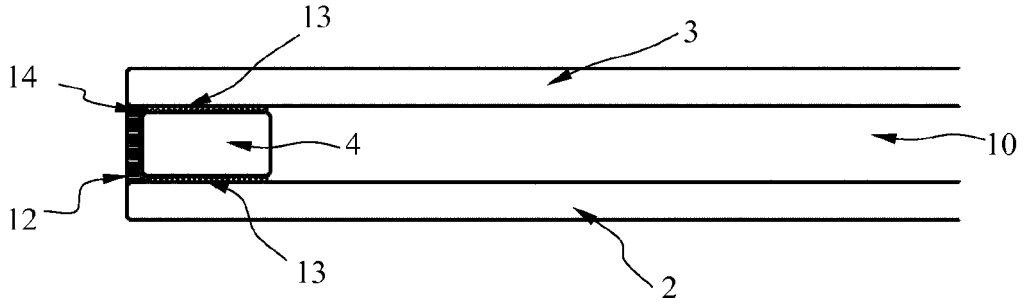
FIG. 6 a fifth embodiment of the connection between a glass spacer and the glass panes.

FIG. 6 shows a fifth embodiment of the connection between a glass spacer 4 and the glass panes 2, 3. In contrast to the external edges of the glass panes 2, 3, the external edge of the glass spacer 4 is offset in the direction of the inner chamber 10. The first primary sealant 13 is disposed between the glass spacer 4 and the glass panes 2, 3. The first secondary sealant 14, and adjacent thereto, the additional layer 12 are disposed on the external edge of the glass spacer 4 in the region between the glass panes 2, 3. The additional layer 12 sits flush with the external edge of the glass panes 2, 3.

Figure 7:
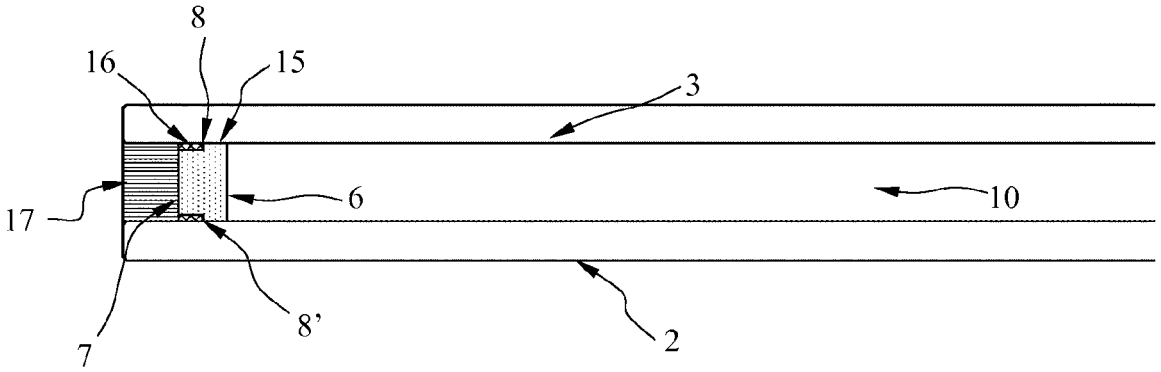
FIG. 7 a first embodiment of the connection between an additional spacer and the glass panes.

FIG. 7 shows a first embodiment of the connection between an additional spacer 6 and the glass panes 2, 3. In contrast to the external edges of the glass panes 2, 3, the external edge of the additional spacer 6 is offset in the direction of the inner chamber 10. Disposed between the glass panes 2, 3 and the additional spacer 6 is a second sealant 8, 8' which consists each of a second primary sealant 15 on the side facing the inner chamber 10 and a second secondary sealant 16 on the side facing the external region. The additional spacer 6 has a gas-tight layer 7 on the side facing the external region. Applied to the external edge of the additional spacer 6 in the region between the glass panes 2, 3 is an adhesive 17 which sits flush with the external edge of the glass panes 2, 3.

Figure 8:
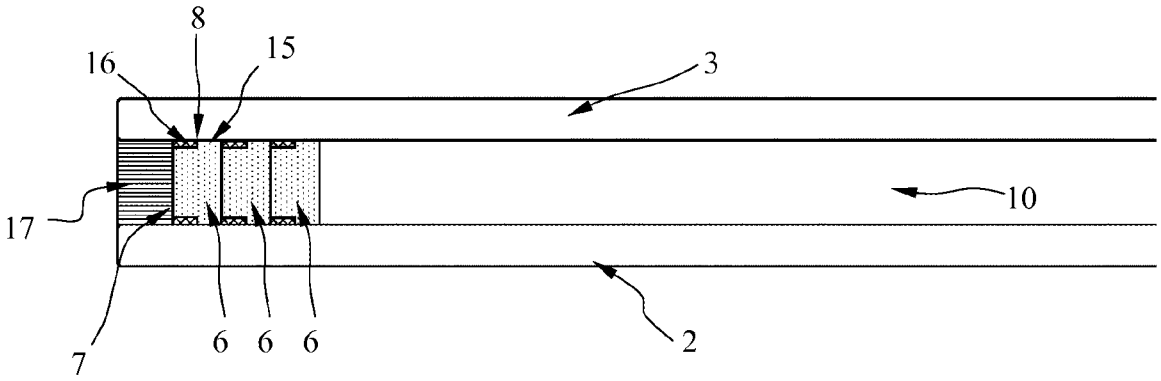
FIG. 8 a second embodiment of the connection between an additional spacer and the glass panes.

FIG. 8 shows a second embodiment of the connection between an additional spacer 6 and the glass panes 2, 3 as shown in FIG. 7. In the current figure, three of the additional spacers 6 with the respective sealants 8, 8' and, the second primary sealants 15 and the second secondary sealants 16, respectively, are disposed one next to the other. The gas-tight layer 7 is disposed only on the outermost of the three additional spacers 6.

Figure 9:
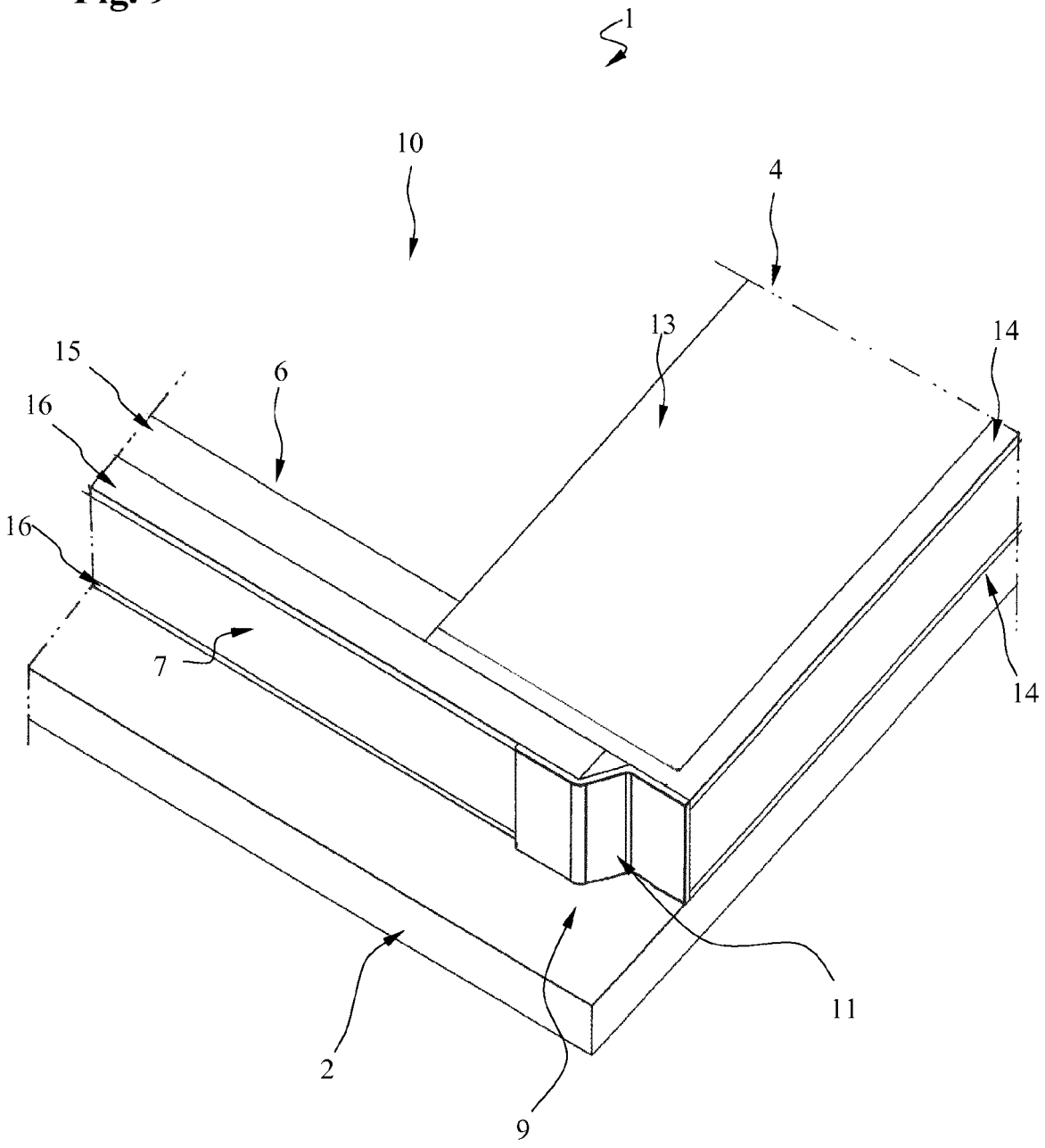
FIG. 9 a first embodiment of the seal sealing the joining region between a glass spacer and an additional spacer.

FIG. 9 shows the insulating glass unit 1 without the second glass pane 3 in a first embodiment of a seal sealing the joining region 9 between a glass spacer 4 and an additional spacer 6. The glass spacer 4 and the additional spacer 6 are attached to the first glass pane 2. On the side facing the glass panes 2, 3, the first primary sealant 13 is disposed on the glass spacer 4. The first secondary sealant 14 is disposed in the region of the upper and lower external edges of the glass spacer 4 and on the short side of the glass spacer 4, which faces the joining region 9. On the side facing the glass panes 2, 3, the second primary sealant 15 is disposed on the additional spacer 6, and in the region of the upper and lower external edges of the additional spacer 6, the second secondary sealant 16 is disposed. Applied to the side facing the external side of the additional spacer 6 is a gas-tight layer 7. In the joining region 9, the additional spacer 6 has a recess R, with the additional spacer 6, on the side facing the inner chamber 10, being cut out up to where the second secondary sealant 16 begins. As a result, the additional spacer 6 and the glass spacer 4 adjoin each other in such a way that the remaining non-recessed region of the additional spacer 6 extends along the short side of the glass spacer 4 on which the first secondary sealant 14 is disposed. This remaining non-recessed portion of the additional spacer 6 does not extend over the entire length of the short side of the glass spacer 4. On the remaining portion of the short side of the glass spacer 4 on which the secondary sealant 14 is disposed, the third sealant 11 is disposed. Here, the third sealant 11 extends from the short side of the glass spacer 4 over the short side of the non-recessed portion of the additional spacer 6 up to the external side of the additional spacer 6, (i.e., the gas-tight layer 7.).

Figure 10:
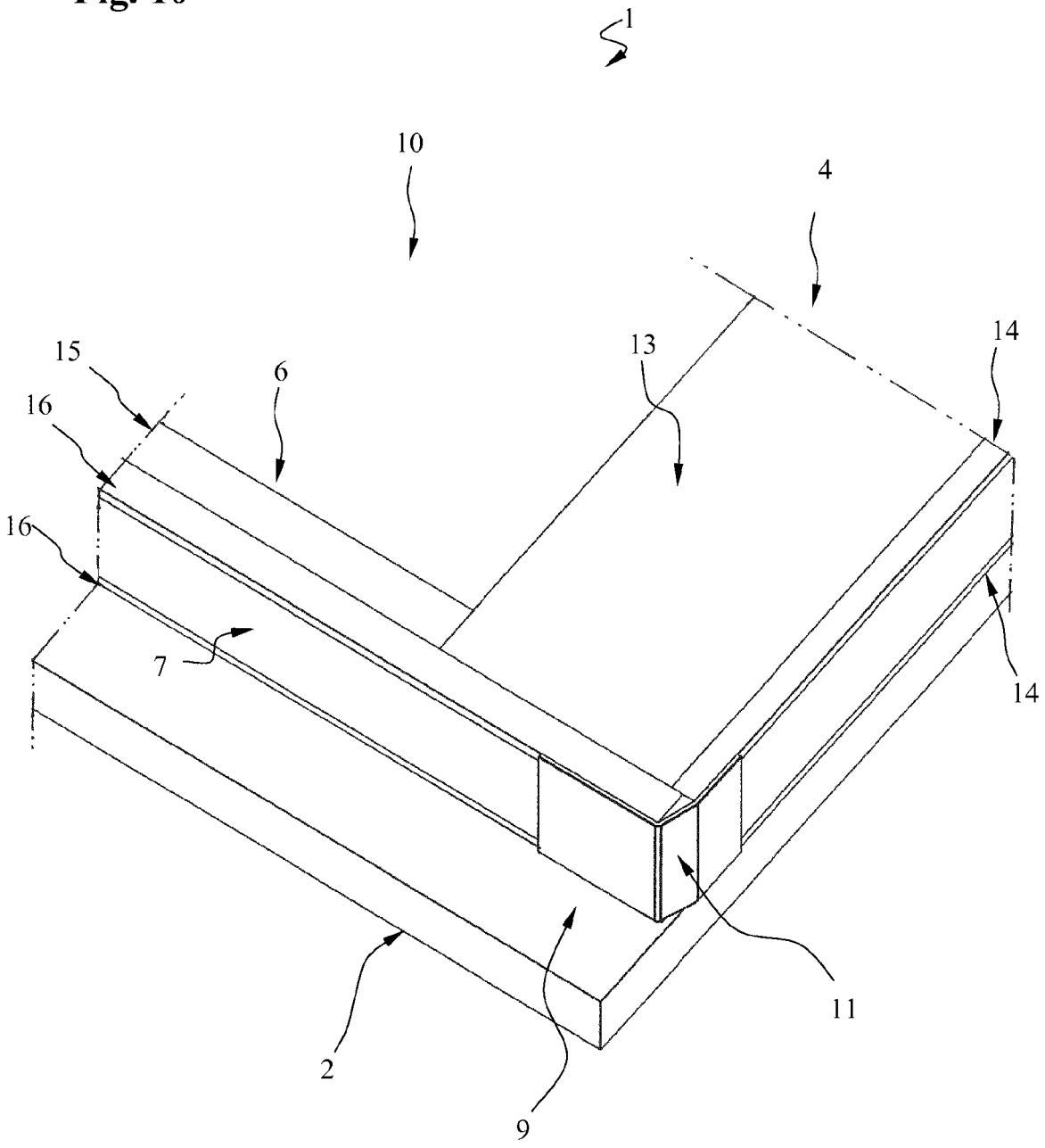
FIG. 10 a second embodiment of the seal sealing the joining region between a glass spacer and an additional spacer.

FIG. 10 shows a second embodiment of the seal sealing the joining region 9 as in FIG. 9. In this figure, the non-recessed portion of the additional spacer 6 extends up to a short distance from the external edge of the short side of the glass spacer 4. In contrast to the embodiment shown in FIG. 9, no first secondary sealant 14 is disposed on the short side of the glass spacer 4. The third sealant 11 here extends from the external side of the glass spacer 4 over the short side of the non-recessed portion of the additional spacer 6 up to the external side of the additional spacer 6 (i.e., the gas-tight layer 7).

The elements of a glass façade must satisfy both esthetic and functional requirements, especially with regard to thermal insulation. To this end, insulating glass units 1 are used, whose individual glass panes 2, 3 are connected to each other by means of spacers in such a way that a gas-tight inner chamber 10 is created, which can be filled with gas, especially a gas with low thermal conductivity, such as argon, xenon, krypton or a mixture thereof.

To avoid a negative effect on the visual appearance of the insulating glass unit 1 and to ensure a pleasing overall visual appearance of the glazing, spacers made of glass are used at least on the visible sides of the insulating glass unit 1 to be installed. The glass spacers 4 preferably have the same composition as the individual glass panes 2, 3 of the insulating glass unit 1. To ensure a gas-tight inner chamber 10, the glass spacers 4 are connected to the glass panes 2, 3 by means of first sealants 5, 5', as illustrated in FIGS. 2-6.

The first sealant 5, 5' shown in FIG. 2 is preferably a transparent sealant containing acrylic, especially in the form of a double-sided adhesive tape. In this context, an acrylic sealant is a sealant which contains acrylic or consists of acrylic. In addition to transparency, such an acrylic sealant provides the required elasticity and mechanical stability for the connection between the glass panes 2, 3 and the glass spacer 4. The acrylic sealant in the form of a double-sided adhesive tape furthermore allows easy processing and thus facilitates the manufacture of the insulating glass unit 1.

The first primary sealant 13 shown in FIGS. 3-6 preferably is the above-described acrylic sealant in the form of a double-sided adhesive tape. The first secondary sealant 14 of FIGS. 3-6 preferably contains butyl. In this context, a butyl sealant is a sealant which contains butyl or consists of butyl. This type of butyl sealant is marked by high gas impermeability and, in addition to the first primary sealant 13, is intended to ensure the gas-tight connection between the glass spacer 4 and the glass panes 2, 3.

The additional layer 12 shown in FIG. 4, which is disposed on the external edge, can consist especially of the above-described butyl sealant or of silicone. A silicone layer serves especially to protect the first secondary sealant 14, especially the paste-like butyl sealant. In the alternative embodiment of FIG. 5, an additional layer 12, preferably in the form of a silicone layer, is applied on top of the layer of the first secondary sealant 14 which was applied to the outside. In the embodiment shown in FIG. 6, an additional layer 12, preferably consisting of the butyl sealant described or of silicone, is applied to the layer of the first secondary sealant 14.

As FIG. 1 shows, in addition to the glass spacers 4, additional spacers 6 are used, inter alia to introduce a drying agent into the insulating glass unit 1, which drying agent is preferably in contact with the inner chamber 10. The drying agent introduced into the additional spacer 6 may contain, for example, silica gels, molecular sieves, $CaCl_2$), $Na_2SO_4$, active charcoal, silicates, bentonites, zeolites and/or mixtures thereof, serves to absorb the residual moisture present in the inner chamber 10 of the insulating glass unit 1. This prevents the glass panes 2, 3 on the side facing the inner chamber 10 from fogging up as a result of moisture condensation. The additional spacers 6 used are preferably commercially available plastic spacers. The body of the plastic spacer, which allows an exchange of air or gas with the inner chamber 10 of the insulating glass unit 1, is filled with a drying agent. On the two sides facing the glass panes 2, 3, the plastic spacer has second sealants 8, 8', especially a second primary sealant 15, preferably in the form of a sealant containing acrylic, and a second secondary sealant 16, preferably a sealant containing butyl. The second secondary sealant 16 adjoins the second primary sealant 15, which faces the inner chamber 10. The long side of the plastic spacer facing the external region has a gas-tight layer 7, preferably in the form of a metal-containing tape, especially a plastic tape coated with aluminum. The gas-tight layer 7 prevents an exchange of gas through the plastic spacer to the outside. In addition to the plastic spacers, other spacers, for example, metal spacers, especially spacers made of aluminum or stainless steel, are also conceivable as additional spacers 6.

The adhesive 17 used in the possible embodiments of the connection between an additional spacer 6 and the glass panes 2, 3, as shown in FIGS. 7 and 8, is preferably a silicone or polyurethane adhesive. Thus, in addition to the second sealants 8, 8' and the second primary sealants 15 and the second secondary sealants 16, respectively, this adhesive additionally bonds the glass panes 2, 3 to each other. The insulating glass unit 1 embodied as a building facade element is preferably mounted on a building facade by means of carrier elements which are disposed in the region of the additional spacers 6. Thus, a negative effect of the additional spacers 6 or the adhesive 17 on the visual appearance is prevented or reduced to a minimum.

The embodiment shown in FIG. 8, in which a plurality of the additional spacers 6 are disposed one next to the other, serves, inter alia, to introduce more drying agents into the insulating glass unit 1. To facilitate the exchange of gas between the inner chamber 10 and all of the additional spacers 6, only the outermost of the additional spacers 6 has a gas-tight layer 7.

In order to use the insulating glass unit 1 as an element of a building façade, the sealants 5, 5', 8, 8', 11 used must be sufficiently resistant especially to natural UV radiation. In this context, a sealant is considered resistant to natural UV radiation if, for example, after the treatment specified in DIN EN ISO 4892-2, it has not undergone any substantial changes over a period of 3000 hours. However, other definitions of UV resistance obvious to those skilled in the art can also be followed, such as a treatment according to the American Standard ANSI Z97.1-2015 which requires that no substantial changes occur over a period of 3000 hours. Since sealants containing transparent butyl are not sufficiently resistant to natural UV exposure, the butyl sealant, especially the sealant used for the secondary sealants 14, 16, is a black butyl sealant which has the UV resistance required. A negative effect on the insulating glass unit 1 caused by the secondary sealant 14, 16, especially by the secondary sealant 14 disposed in the region of the glass spacers 4, is negligible since this sealant is applied only in a thin layer.

To obtain a gas-tight inner chamber 10, it is necessary, in addition to the gas-tight connection between the glass spacer 4 and the glass panes 2, 3 and between the additional spacer 6 and the glass panes 2, 3, to seal the joining region between a glass spacer 4 and an additional spacer 6 with a gas-tight seal. Special attention must be paid to the short side of the additional spacers 6, which does not have a gas-tight layer 7 and could therefore make a gas exchange possible. FIGS. 9 and 10 show two possible embodiments, in which the inside portion of the additional spacer 6, especially of a plastic spacer, is cut out to create the recesses for the additional spacers 6 in the joining region 9. In these figures, the third sealant 11, which extends from the glass spacer 4 up to the external side of the additional spacer 6, covers especially the gas-permeable short side of the additional spacer 6. The third sealant 11 used is especially a sealant containing butyl or a metal-containing tape. The third sealant 11 used is preferably a butyl tape laminated with a metal-containing tape, especially a butyl tape laminated with an aluminum tape.

To fill the inner chamber 10 of the insulating glass unit 1 with gas, the at least one additional spacer 6 is punctured in at least two areas to create a gas inlet and a gas outlet. Via the inlet, the inner chamber 10 is subsequently filled with the gas to be introduced until only the gas to be introduced can be detected at the outlet. The inlet and the outlet are subsequently sealed with a gas-tight seal by means of a sealant, especially a butyl sealant.

To manufacture a building facade element embodied as an insulating glass unit 1 according to the present invention, glass spacers 4 are placed on the long side of the lower first glass pane 2 on top of the first primary sealant 13, preferably in the form of the above-described double-sided acrylic adhesive tape, and along the external edges of the glass spacer 4 on top of the first secondary sealant 14, preferably in the form of a butyl string. The additional spacers 6, preferably in the form of the commercially available plastic spacers described, are provided with the recesses described and are attached to the short sides of the first glass pane 2 adjacent to the glass spacers 4. After placement of the second glass pane 3, the insulating glass unit 1 is joined together under pressure. Subsequently, the joining region 9 is sealed by means of the third sealant 11, the inner chamber 10 is filled with gas, the adhesive 17 is applied to the external side of the plastic spacers, and one additional layer or a plurality of additional layers 12 of a butyl sealant or of silicone is/are applied to the edge of the insulating glass unit 1.

In other embodiments, at least one of the glass panes 2, 3 can be provided with a metal layer, for example, a sun protection layer or a thermal protection layer.

Also conceivable are insulating glass units 1 which are constructed of more than two glass panes 2, 3 and a plurality of inner chambers 10.

Furthermore, given the length of the building facade elements, it is possible for a glass spacer 4 to be composed of a plurality of components, especially of a plurality of glass components disposed one next to the other.

LIST OF REFERENCE CHARACTERS

1 Insulating glass unit
2 First glass pane
3 Second glass pane
4 Glass spacer
5 First sealant
6 Spacer
7 Gas-tight layer
8 Second sealant
9 Joining region
10 Inner chamber
11 Third sealant
12 Layer
13 First primary sealant

14 First secondary sealant
15 Second primary sealant
16 Second secondary sealant
17 Adhesive

The invention claimed is:

1. A building facade element embodied as an insulating glass unit, comprising:

at least one first and at least one second glass panes;

at least one glass spacer made of glass and connected to each of the at least one first and at least one second glass panes by at least one first sealant, the at least one glass spacer having at least one short side and at least one long side;

at least one additional spacer which is gas-tight or which has a gas-tight layer and which is connected to each of the at least one first and at least one second glass panes by at least one second sealant; and at least one joining region between the at least one glass spacer and the at least one additional spacer, wherein the at least one glass spacer, the at least one additional spacer, and the at least one first and at least one second glass panes form a sealed inner chamber, part of the at least one additional spacer is recessed proximal the at least one joining region such that the at least one additional spacer has a first portion facing an external region that extends further so as to be longer than a second portion facing the inner chamber, with the first portion of the at least one additional spacer extending along an edge of the at least one short side of the at least one glass spacer that faces the external region, and the at least one joining region is sealed so as to be gas-tight by a third sealant which contains butyl and which extends over the joining region.

2. The building facade element of claim 1, wherein the third sealant comprises a metal-containing tape.

3. The building facade element of claim 1, wherein the at least one first sealant includes a first primary sealant disposed between the glass panes and an inner portion of the at least one glass spacer, which faces the inner chamber, and a first secondary sealant disposed between the glass panes and an outer portion of the at least one glass spacer, which faces the external region, with the first secondary sealant also being disposed on an external side of the at least one glass spacer.

4. The building facade element of claim 1, wherein at least one additional layer of the third sealant and/or of silicone is disposed on an edge of the insulating glass unit.

5. The building facade element of claim 1, wherein the at least one first, at least one second, and third sealants are resistant to natural UV radiation.

6. The building facade element of claim 1, wherein the at least one first sealant includes a first primary sealant disposed between the glass panes and an inner portion of the at least one glass spacer, which faces the inner chamber, and a first secondary sealant disposed between the glass panes and an outer portion of the at least one glass spacer, which faces the external region, and the at least one second sealant includes a second primary sealant disposed between the glass panes and an inner portion of the at least one additional spacer, which faces the inner chamber, and a second secondary sealant disposed between the glass panes and an outer portion of the at least one additional spacer, which faces the external region.

7. The building facade element as in claim 6, wherein at least one of the first primary, first secondary, second primary, and second secondary sealants is transparent, the first primary sealant and/or the second primary sealant contains acrylic, the first primary sealant and/or the second primary sealant is a double-sided adhesive tape, and the first secondary sealant and/or the second secondary sealant contains butyl.

8. The building facade element of claim 1, wherein the at least one first sealant includes a first primary sealant disposed between the glass panes and an inner portion of the at least one glass spacer, which faces the inner chamber, and a first secondary sealant disposed between the glass panes and an outer portion of the at least one glass spacer, which faces the external region, with the first primary sealant containing acrylic and the first secondary sealant containing butyl which is resistant to natural UV radiation.

9. The building facade element of claim 8, wherein the first secondary sealant is a black butyl sealant and the first primary sealant is transparent.

10. The building facade element of claim 1, wherein the inner chamber is filled with gas, and at least one of the at least one first and at least one second glass panes is coated on at least one side with a metal coating.

11. The building facade element of claim 1, wherein the at least one additional spacer is a plastic spacer or a metal spacer, and the at least one additional spacer comprises a drying agent.

12. The building facade element of claim 1, wherein the at least one additional spacer has a gas-tight layer that is a metal-containing tape.

13. The building facade element of claim 1, wherein the at least one additional spacer comprises a plurality of additional spacers which are disposed one next to another.

14. The building facade element of claim 10, wherein the inner chamber is filled with at least one of argon, krypton and xenon gas.

15. The building facade element of claim 11, wherein the at least one additional spacer is an aluminum or stainless steel spacer.

16. The building facade element of claim 1, wherein the second portion of the at least one additional spacer does not extend along the edge of the at least one short side of the at least one glass spacer.

17. The building facade element of claim 1, wherein a side of the second portion of the at least one additional spacer abuts the at least one long side of the at least one glass spacer.

18. The building facade element of claim 1, wherein the at least one second sealant includes a second primary sealant disposed between the glass panes and an inner portion of the at least one additional spacer, which faces the inner chamber, and a second secondary sealant disposed between the glass panes and an outer portion of the at least one additional spacer, which faces the external region.

19. A building facade element of claim 3, embodied as an insulating glass unit, comprising:

at least one first and at least one second glass panes;

at least one glass spacer made of glass and connected to each of the at least one first and at least one second glass panes by at least one first sealant, the at least one glass spacer having at least one short side and at least one long side;

at least one additional spacer which is gas-tight or which has a gas-tight layer and which is connected to each of the at least one first and at least one second glass panes by at least one second sealant; and at least one joining region between the at least one glass spacer and the at least one additional spacer, wherein the at least one glass spacer, the at least one additional spacer, and the at least one first and at least one second glass panes form a sealed inner chamber, part of the at least one additional spacer is recessed proximal the at least one joining region such that the at least one additional spacer has a first portion facing an external region that extends further so as to be longer than a second portion facing the inner chamber, with the first portion of the at least one additional spacer extending along the at least one short side of the at least one glass spacer, the at least one joining region is sealed so as to be gas-tight by a third sealant which contains butyl and which extends over the joining region, and the first portion of the at least one additional spacer does not extend over an entire length of the at least one short side of the at least one glass spacer, with the third sealant extending from a portion of the at least one short side of the at least one glass spacer up to a portion of an external side of the first portion of the at least one additional spacer.

20. A building facade element embodied as an insulating glass unit, comprising:

at least one first and at least one second glass panes;

at least one glass spacer made of glass and connected to each of the at least one first and at least one second glass panes by at least one first sealant, the at least one glass spacer having at least one short side and at least one long side;

at least one additional spacer which is gas-tight or which has a gas-tight layer and which is connected to each of the at least one first and at least one second glass panes by at least one second sealant; and at least one joining region between the at least one glass spacer and the at least one additional spacer, wherein the at least one glass spacer, the at least one additional spacer, and the at least one first and at least one second glass panes form a sealed inner chamber, part of the at least one additional spacer is recessed proximal the at least one joining region such that the at least one additional spacer has a first portion facing an external region that extends further so as to be longer than a second portion facing the inner chamber, with the first portion of the at least one additional spacer extending along the at least one short side of the at least one glass spacer, the at least one joining region is sealed so as to be gas-tight by a third sealant which contains butyl and which extends over the joining region, the first portion of the at least one additional spacer does not extend over an entire length of the at least one short side of the at least one glass spacer, the second portion of the at least one additional spacer does not extend along the at least one short side of the at least one glass spacer, and a side of the second portion of the at least one additional spacer abuts the at least one long side of the at least one glass spacer.

* * * * *